US006519972B1

(12) United States Patent
Siebenberg

(10) Patent No.: US 6,519,972 B1
(45) Date of Patent: Feb. 18, 2003

(54) MULTI-STONE OVAL GEMSTONE ASSEMBLY

(75) Inventor: Benjamin N. Siebenberg, White Plains, NY (US)

(73) Assignee: Am-Gold Products, Inc., New York, NY (US)

( * ) Notice: Subject to any disclaimer, the term of this patent is extended or adjusted under 35 U.S.C. 154(b) by 0 days.

(21) Appl. No.: 09/534,585

(22) Filed: Mar. 27, 2000

(51) Int. Cl.[7] ..... A44C 17/00

(52) U.S. Cl. ..... 63/32; 63/26; 63/28; D11/89; D11/90; D11/91; D11/92

(58) Field of Search ..... 63/26, 28, 32; D11/89, 90, 91, 92

(56) References Cited

U.S. PATENT DOCUMENTS

| | | | | | |
|---|---|---|---|---|---|
| D73,110 | S | * | 7/1927 | Stern | D11/90 |
| 3,394,692 | A | * | 7/1968 | Sirakian | 125/30.01 |
| 5,533,364 | A | * | 7/1996 | Freilich | 63/32 |
| D388,015 | S | * | 12/1997 | Itzkowitz | D11/90 |
| D389,087 | S | * | 1/1998 | Kattan | D11/90 |
| D392,589 | S | * | 3/1998 | Bachar | D11/90 |
| D399,165 | S | * | 10/1998 | Katz | D11/90 |
| D402,913 | S | * | 12/1998 | Katz | D11/90 |
| D405,024 | S | * | 2/1999 | Katz | D11/90 |
| D415,062 | S | * | 10/1999 | Wolf | D11/90 |
| 6,007,907 | A | * | 12/1999 | Wolf | 428/323 |
| D435,478 | S | * | 12/2000 | Chan | D11/92 |
| 6,171,666 | B1 | * | 1/2001 | Wolf | 428/15 |
| D455,977 | S | * | 4/2002 | Shah | D11/90 |
| D457,094 | S | * | 5/2002 | Cohen | D11/92 |
| D460,018 | S | * | 7/2002 | Chan | D11/92 |

* cited by examiner

*Primary Examiner*—J. J. Swann
*Assistant Examiner*—Andrea Chop
(74) *Attorney, Agent, or Firm*—Levisohn, Lerner, Berger & Langsam, LLP

(57) ABSTRACT

An assembly of gemstones which fit together to form a unitary shape is provided. The stones preferably make up an oval and are preferably four in number. Two of the stones are smaller than the other two. The larger stones are approximately 5/3 the size of the smaller stones.

5 Claims, 1 Drawing Sheet

MULTI-STONE OVAL GEMSTONE ASSEMBLY

BACKGROUND OF THE INVENTION

1. Field of the Invention

The invention relates to jewelry, and more particularly it relates to small gemstones fitted together to appear as one larger gemstone.

2. Description of the Related Art

Jewelry including diamonds and gemstones are widely known. Because precious and semi-precious gemstones are expensive—typically, the larger the stone, the more expensive the stone—, it is also known to use several smaller stones fitted together to resemble one large stone. Typically, the stones are fitted together to make a round design that simulates a single larger round-cut stone.

The traditional setting for fitting together several small stones to resemble one large stone is a cup- or bowl-shaped setting. The cup shape provides a great deal of security in preventing the stones from coming loose or falling out. The instant inventor has developed a prong setting for multiple gemstones described in pending U.S. Pat. No. 6,389,846 filed on Mar. 10, 2000, the teachings of which are fully incorporated by reference herein.

SUMMARY OF THE INVENTION

It is an object of the invention to provide the appearance of a large oval stone from several smaller stones.

The above and other objects are fulfilled by the invention which is a multi-stone oval gemstone or diamond. The overall jewelry device is one large oval gemstone comprised of several, preferably four, smaller triangular-shaped stones. The side facets of the smaller stones are cut so as to meet at a point with no gaps between the smaller stones. Preferably, two of the stones are larger than the other two.

DETAILED DESCRIPTION OF THE PREFERRED EMBODIMENT AND THE DRAWING

Figure 1:
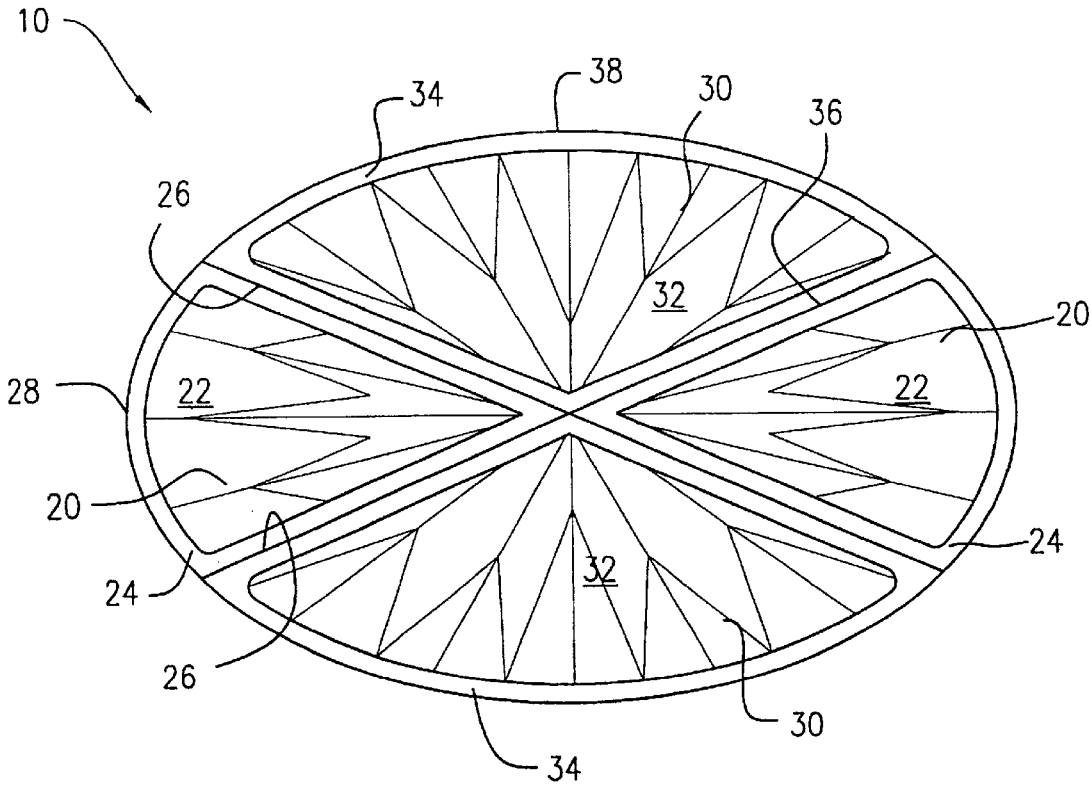
FIG. 1 depicts a top elevation view of a multi-stone oval gemstone in accordance with the invention.

Description of the invention will now be given with reference to the attached FIG. 1. One large assembly 10 of smaller stones is provided. In the preferred embodiment, four stones are provided which make up assembly 10. Two smaller stones 20 are provided with two larger stones 30 in an alternating configuration of smaller, larger, smaller, larger. Smaller stones 20 each include table 22 and side facets 24 which substantially surround the table. The overall shape of smaller stones 20 is predominantly triangular, having two straight sides 26 with a rounded outer side 28. The larger stones 30 are similar to the smaller stones; each has a table 32, side facets 34 which substantially surround table 32. Stones 30 are also predominantly triangular in shape, having two straight sides 36 and a rounded outer side 38.

The stones 20 and 30 are shaped so that when their respective sides 26 and 36 are abutting, their respective points all meet at a central point. Preferably, the size ratio of the larger stones to the smaller stones is 5:3. For example, one embodiment employs two 0.25 carat stones 30 and two 0.15 carat stones 20.

The multi-stone assembly 10 may be set in a traditional cup setting or it may be set with prongs in accordance with the above-cited prong setting created by the instant inventor and assigned to the same assignee.

The invention is not limited to the specific representation shown in the drawings. For example, an oval assembly comprised a different number of smaller stones, e.g., three, five, etc. Also, any type of jewel or gemstone is intended to be covered, be it diamonds, emeralds, rubies, sapphires, costume jewelry, or the like.

What is claimed is:

1. An oval shape multi-stone composite gemstone assembly comprising two pairs of gemstones, each of said gemstones formed by three sides, said three sides comprising pairs of straight sides emanating from a point forming an angle and an outer rounded side connected to said straight sides, said two pairs of gemstones comprising one pair of north-south gemstones and one pair or east-west gemstones with said north gemstone having its straight sides abut one of the straight sides of each of said east-west gemstones and the south gemstone having its straight sides abut on the other of the straight sides of each of said east-west gemstones whereby said gemstones abut each other, meet at a center point and form said oval shape due to the contiguous relationship of the outer rounded sides of said gemstones, each of said north and south gemstones being substantially identical to each other and each of said east and west gemstones being substantially identical to each other, the angle formed by the straight sides of said north-south gemstones comprising an obtuse angle and the angle formed by the straight sides of said east-west gemstones comprising an acute angle, the sum of one obtuse and one acute angle of said obtuse and acute angles equaling substantially 180°.

2. A multi-stone gemstone assembly according to claim 1, wherein a weight ratio of said north-south gemstones to said east-west gemstones is substantially 5:3.

3. A multi-stone gemstone assembly according to claim 1, wherein side facets of each of said four gemstones are visible from the top of said multi-stone composite gemstone.

4. A multi-stone gemstone assembly according to claim 3, wherein said gemstones are diamonds.

5. A multi-stone gemstone assembly according to claim 1, wherein said gemstones are diamonds.

* * * * *